US006373177B1

(12) United States Patent
Han et al.

(10) Patent No.: US 6,373,177 B1
(45) Date of Patent: Apr. 16, 2002

(54) SHADOW MASK FOR CATHODE RAY TUBE AND METHOD OF MANUFACTURING SAME

(75) Inventors: Dong-hee Han; Sung-hwan Moon, both of Kyungki-do; Seung-kwon Han, Seoul, all of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/203,797

(22) Filed: Dec. 1, 1998

(30) Foreign Application Priority Data

Dec. 1, 1997 (KR) ..... 97-65013
Jan. 22, 1998 (KR) ..... 98-1855

(51) Int. Cl.[7] ..... H01J 29/80
(52) U.S. Cl. ..... 313/402; 313/408; 445/47
(58) Field of Search ..... 313/402, 403, 313/404, 405, 406, 407, 408; 445/10, 11, 12, 14, 24, 47; 427/249

(56) References Cited

U.S. PATENT DOCUMENTS 3,892,890 A * 7/1975 Watanabe et al. ..... 427/249
4,713,576 A * 12/1987 Misumi et al. ..... 313/402
5,578,898 A * 11/1996 Higashinakagawa et al. .... 313/402

FOREIGN PATENT DOCUMENTS

JP 56-121257 9/1981
JP 62-223950 10/1987
JP 1-276542 11/1989

* cited by examiner

*Primary Examiner*—Nimeshkumar D. Patel
*Assistant Examiner*—Todd Reed Hopper
(74) *Attorney, Agent, or Firm*—Christie, Parker & Hale, LLP

(57) ABSTRACT

A shadow mask for a cathode ray tube includes a surface hardening layer and a solid-solution and precipitation hardening layer formed under the surface hardening layer.

9 Claims, 3 Drawing Sheets

SHADOW MASK FOR CATHODE RAY TUBE AND METHOD OF MANUFACTURING SAME

CROSS REFERENCE TO RELATED APPLICATION

This application is based on application Nos. 97-65103 and 98-1855 filed in Korean Industrial Property Office on Dec. 1, 1997 and Jan. 22, 1998 respectively, the contents of which are incorporated hereinto by reference.

FIELD OF THE INVENTION

The present invention relates to a shadow mask for a cathode ray tube (CRT) and a method of manufacturing the same and, more particularly, to a method of manufacturing a CRT shadow mask having improved tensional strength and elongation.

BACKGROUND OF THE INVENTION

A CRT shadow mask selects appropriate red, green and blue colors by shadowing selected areas of the screen from electron beams.

Generally, such a shadow mask is made by first coating photoresist on a thin metal plate. The plate is then exposed to light and, subsequently, developed and etched to form a plurality of holes thereon. Thereafter, the plate formed with the holes is annealed by heat treatment under a hydrogen atmosphere at a high temperature. The annealing step removes inner stress from the plate while causing elongation thereof. The plate is then formed with a predetermined mask shape by the use of a press and degreased to remove oil or alien materials therefrom. Finally, for an oxidization-preventing or heat-absorbing purpose, the degreased plate is processed with a blackening step. The resulting mask shaped plate is mounted within the CRT panel to function as a color selecting shadow mask.

The shadow mask acts as a physical barrier to electron beams as they progress from one location to the next, and minimizes the generation of spurious colors by excitation of the wrong phosphor. However, when an external shock or impact or a sound wave from the built-in speaker is applied to the shadow mask, it is liable to be seriously vibrated due to its structural weakness so that the electron beam passing therethrough may land on the wrong phosphor, resulting in a deterioration of color purity.

FIGS. 1 and 2 each show a panel assembly where the aforementioned phenomenon is schematically illustrated. As shown in FIG. 1, the panel assembly includes a panel 1, a phosphor screen 2 formed on an inner surface of the panel 1, and a shadow mask 6 placed directly behind the phosphor screen 2 and provided with a plurality of beam-guide holes 8. The shadow mask 6 is supported by a mask frame 5. The mask frame 5 is coupled to a stud pin 3 protruding from the side wall of the panel 1 by interposing a spring 4 therebetween.

When the external shock or impact is applied to the shadow mask 6, the shadow mask 6 is shaken such that it moves from ts initial position to a new position 7. With the movement of the shadow mask 6, the beam-guide hole 8 also moves from its initial position to a new position 9. Accordingly, an electron beam 10 emitted from an electron gun 11 takes a wrong course such that its landing position is changed from P1 to P2, resulting in excitation of the wrong phosphor.

Furthermore, when a physically strong shock is applied to the CRT, the shadow mask 6 is liable to be partially deformed. Such a deformed portion 12 is indicated in FIG. 2. As the electron beam 10 passes through the deformed portion 12 and lands on the phosphor screen 2, spurious colors are generated.

The aforementioned shortcomings are mainly derived from the poor tensional strength of the shadow mask. Since the shadow mask is usually made of a thin metal plate, it should pass through several rolling steps during the manufacturing process to be provided with appropriate structural hardness. The annealing step is employed to give such a characteristic to the metal plate and is performed before the forming step which requires some degree of elongation of the target material. As shown in FIG. 5, when this annealing step is absent, the metal plate has high tensional strength but poor elongation so that it is practically impossible to form the metal plate with a mask shape. On the contrary, as shown in FIG. 6, when the annealing step is present, the metal plate has high elongation but poor tensional strength so that the resulting shadow mask should bear the aforementioned defects of easily vibrating or deforming at an external shock or impact.

In order to solve the problem, Japanese Patent Laid-Open No. Sho 62-223950 discloses a technique of improving tensional strength of the shadow mask by forming a plating layer thereon. However, this technique involves reduced beam-guide hole size. Furthermore, Japanese Patent Laid-Open Nos. Sho 56-121257 and Hei 1-276542 each disclose a technique of improving tensional strength of the shadow mask by performing gas heat-treatment with respect to the shadow mask. However, with this technique, the shadow mask passing through the press-forming step is heat-treated at a high temperature for a long time so that it may be thermally deformed.

SUMMARY OF THE INVENTION

It is an object of the present invention to provide a CRT shadow mask having improved tensional strength and elongation.

It is another object of the present invention to provide a CRT shadow mask having an improved coefficient of elasticity.

It is still another object of the present invention to provide a method of manufacturing a CRT shadow mask having at least one of an improved coeffcient of elasticity, and an improved tensional strength and elongation.

In order to achieve these objects and others, the CRT shadow mask includes a surface hardening layer, and a solid-solution and precipitate hardening layer formed under the surface hardening layer.

The method of manufacturing the CRT shadow mask includes the steps of heat-treating a metal plate with a carbonitriding gas, and forming the metal plate with a predetermined mask shape.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Figure 1:
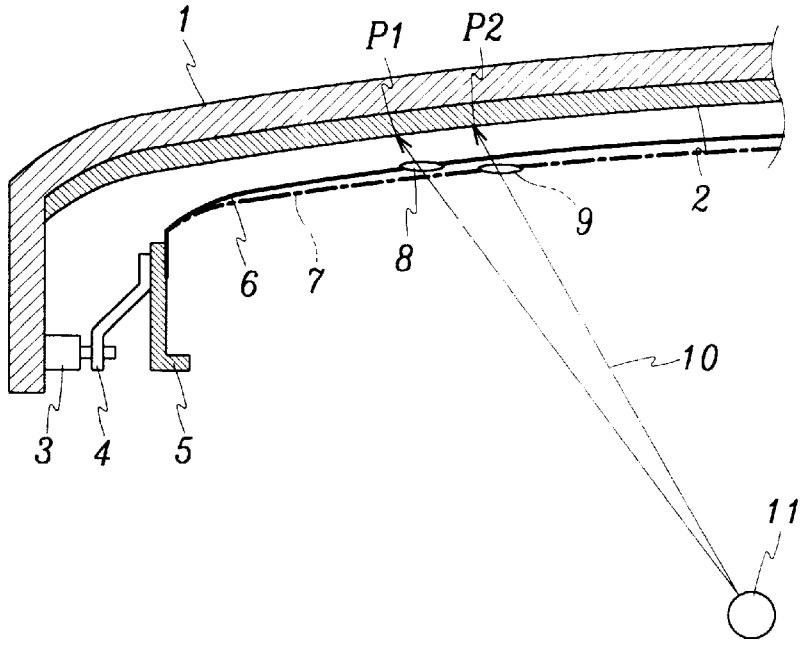
FIG. 1 is a fragmentary cross sectional view showing a phenomenon wherein a route of the electron beam is changed by vibrating the shadow mask caused by the external shock.
Figure 2:
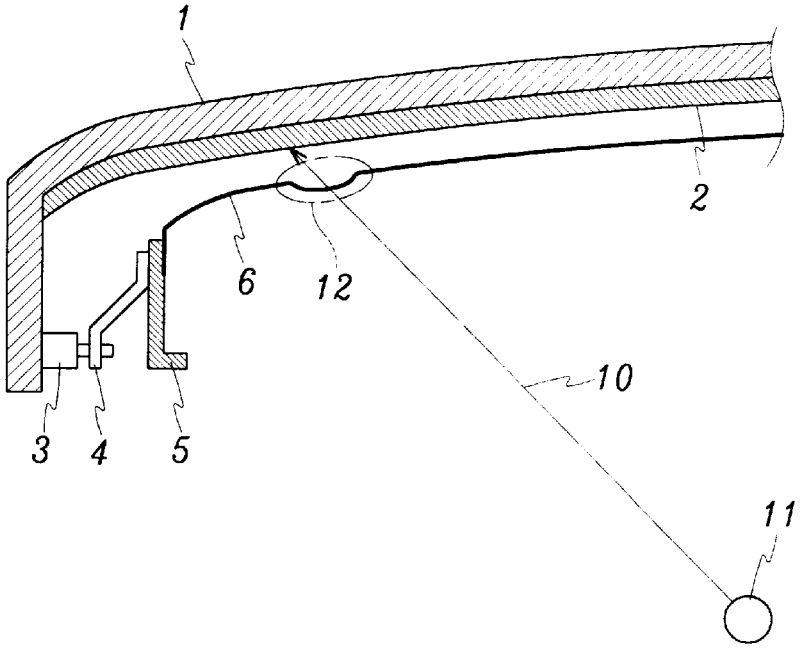
FIG. 2 is a fragmentary cross sectional view showing a partially deformed shadow mask of a cathode ray tube caused by strong shock.

A CRT shadow mask according to a preferred embodiment of the present invention is shown in FIG. 7. The shadow mask 6' includes a surface hardening layer 14 with nitrogen compounds and an interior hardening layer 13 with carbon compounds.

A method of manufacturing such a shadow mask employs a carbonitriding process instead of the conventional annealing step.

In the carbonitriding process, a metallic plate for forming a shadow mask is heat-treated at a high temperature in a gaseous atmosphere containing endothermic RX gas, propane and ammonia. The atmospheric gases are decomposed into carbon and nitrogen atoms. The carbon and nitrogen atoms are diffused into the metallic plate and react with the base metal components to form carbon and nitrogen compounds, such as Fe—Ni—C type compound, Fe—Ni—N type compound, $Fe_3C$, $Fe_2N$, $Fe_4N$, or FeN. The carbon compounds are solidified and precipitated mainly in the interior portion of the metallic plate to thereby form an interior hardening layer. In contrast, the nitrogen compounds are mainly generated in the surface portion of the metallic plate to thereby form a surface hardening layer. At this time, the amount of carbon component contained in the metallic plate is between 0.01 and 2.0 wt % while the amount of nitrogen component therein is between 0.01 and 2.5 wt %, where wt % is the percentage of total weight of the plate.

The shadow mask having such interior and surface hardening layers is endowed with a tensional strength one hundred times more than that of the shadow mask processed from an annealing step. Furthermore, as the metallic plate for forming the shadow mask is heat-treated at a high temperature, the rolled structure of the metallic plate is uniformly re-crystallized with even grains. Thus, such a metallic plate has an improved elongation sufficient for enduring the mask forming step. In addition, with the carbonitriding process, the coefficient of elasticity of the shadow mask increases so that its vibration can be reduced.

The shadow mask manufacturing method will be now described in detail.

Metallic plates made of a low thermal expansion material such as invar or aluminum-killed (AK) steel that have passed through a beam-guide aperture etching step are first stacked and loaded into a tray. When a preparatory furnace reaches a temperature between 100 and 20° C., the tray is put into the preparatory furnace.

When a temperature of a reacting furnace reaches at least about 150° C., carbonitriding gases including RX gas, propane and ammonia are injected into the reacting furnace. The RX gas contains 40% $H_2$, 40% $N_2$ and 20% CO. The injecting amounts of the carbonitriding gases are as follows: 5 to 25l/min. for RX gas, 1 to 10l/min. for propane and 1 to 15l/min. for ammonia.

When the temperature of the reacting furnace is maintained between 400 and 1200° C. under the suitable gaseous atmosphere, the metallic plates in the preparatory furnace are conveyed into the reacting furnace. At this time, RX gas, propane and ammonia are decomposed into carbon and nitrogen atoms. These carbon and nitrogen atoms are permeated and diffused into the metallic plates to react with the metal components therein. When the temperature of the reacting furnace is below 400° C., decomposition of carbon and nitrogen atoms do not occur. In contrast, when the temperature of the reacting furnace is above 1200° C., there is no additional advantage.

In order to sufficiently perform the carbonitriding process, the metallic plates are allowed to stand in the reacting furnace between 0.1 and 5 hours. When the processing time is less than 0.1 hours, the carbon and nitrogen atoms do not sufficiently react with the metal components in the metallic plate. In contrast, when the processing time is more than 5 hours, there is no additional advantage.

The metallic plate may be directly put into the reacting furnace without performing the pre-heating step. In such a case, as carbon and nitrogen atoms are separately decomposed from the carbonitrizing gases at different temperatures, they also react with the metal components in the metallic plate separately. As a result, the carbonitrizing effect is not as satisfactory as a carbonitrizing process which includes a preheating step where the carbonizing and nitrizing reactions simultaneously occur.

As described above, the shadow mask processed from the carbonitrizing process has a desired tensional strength and elongation. This sufficient tensional strength makes it possible to prevent vibration or deformation of the shadow mask at an external shock or impact.

Furthermore, as the carbonitrizing process is performed before the forming step, the resulting shadow mask is free from the defects due to heat-treatment.

The present invention is further explained in more details with reference to the following examples which are within the scope of this invention.

EXAMPLE 1

Metallic plates made of invar steel that have passed through the beam-guide aperture etching step were stacked and loaded into a tray. When a temperature of a preparatory furnace reached 150° C., the tray was put into the preparatory furnace.

When a temperature of a reacting furnace reached at least about 150° C., carbonitriding gases including RX gas, propane and ammonia were injected into the reacting furnace. The injecting amounts of the carbonitriding gases were as follows: 15l/min. for RX gas, 3l/min. for propane and 5l/min. for ammonia.

When the temperature of the reacting furnace was maintained at 850° C. under the suitable gaseous atmosphere, the metallic plates in the preparatory furnace were conveyed into the reacting furnace.

The metallic plates were allowed to stand in the reacting furnace for 1 hour in order to sufficiently perform the carbonitriding process.

When the carbonitiriding process was complete, the temperature of the reacting furnace was lowered to 150° C. and the gas injection was ceased, while the atmosphere of the reacting furnace was maintained. After removing the metallic plates from the reacting furnace, a press forming step was performed to produce a shadow mask.

The amounts of carbon and nitrogen components contained in the shadow mask prepared from Example 1 were determined. The shadow mask prepared from Example 1 includes carbon component of 0.3 wt % based on the shadow mask and nitrogen component of 0.5 wt % based on the shadow mask.

Figure 3:
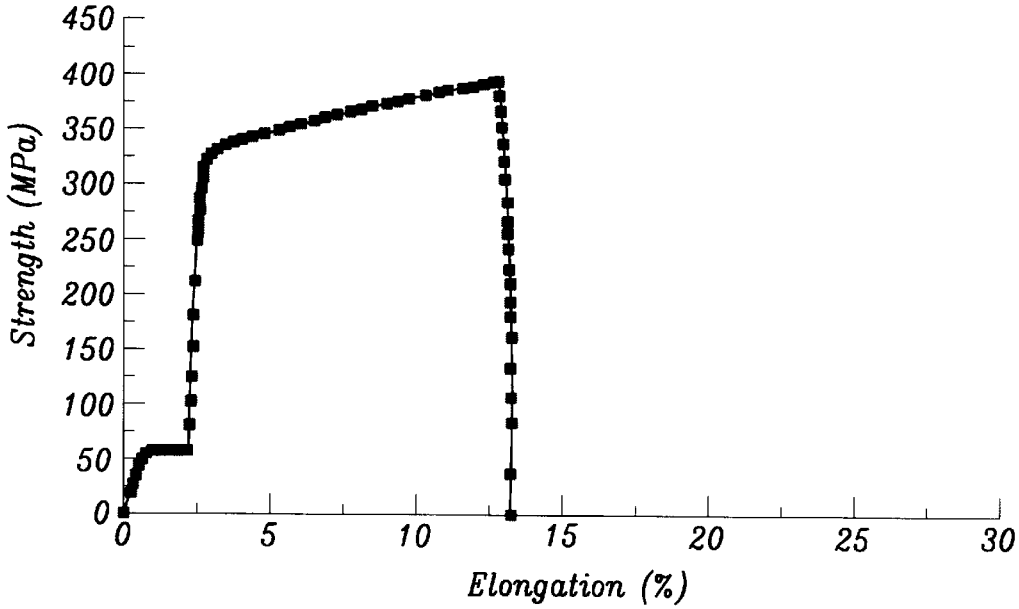
FIG. 3 is a graph illustrating strength versus elongation of the shadow mask prepared by a carbonitriding heat-treatment according to one embodiment of the present invention.

The elongation and strength of the shadow mask prepared by the above method were determined and the results are shown in FIG. 3.

EXAMPLE 2

Metallic plates made of invar steel that have passed through the beam-guide aperture etching step were first stacked and loaded into a tray. When a temperature of a preparatory furnace reached at 150° C., the tray was put into the preparatory furnace.

Meanwhile, when the temperature of a reacting furnace reached at least 150° C., carbonitriding gases including RX gas, propane and ammonia were injected into the reacting furnace. The injecting amounts of the carbonitriding gases were as follows: 15l/min. for RX gas, 3l/min. for propane and 5l/min. for ammonia.

When the temperature of the reacting furnace was maintained at 850° C. under the suitable gaseous atmosphere, the metallic plates in the preparatory furnace were conveyed into the reacting furnace.

The metallic plates were allowed to stand in the reacting furnace for 3 hours in order to sufficiently perform the carbonitriding process. When the process was complete, the temperature of the reacting furnace was lowered to 150° C. and the injection of the gases was ceased, while the atmosphere of the reacting furnace was maintained. After removing the mask from the reacting furnace, the press forming step was performed to produce a shadow mask.

The amounts of carbon and nitrogen components included in the shadow mask prepared from Example 2 were determined. The shadow mask prepared from Example 2 includes carbon component of 0.5 wt % based on the shadow mask and nitrogen component of 0.7 wt % based on the shadow mask.

Figure 4:
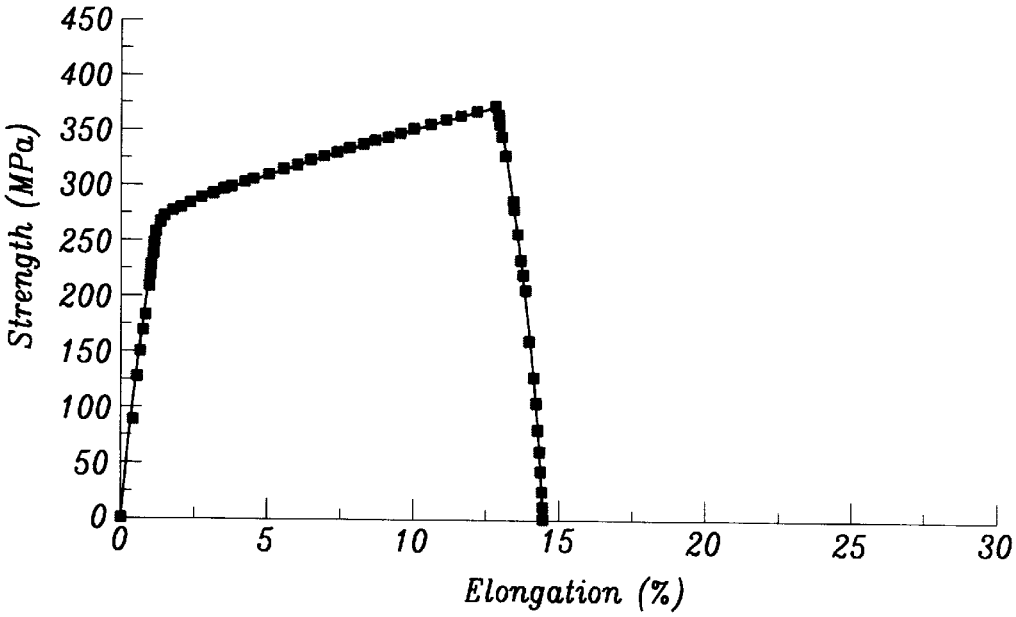
FIG. 4 is a graph illustrating strength versus elongation of the shadow mask prepared by a carbonitriding heat-treatment according to another embodiment of the present invention.

The elongation and strength of the shadow mask prepared by the above method were determined and the results are shown in FIG. 4.

As shown in FIGS. 3 and 4, the shadow masks prepared from Examples 1 and 2 have a desired tension strength and elongation.

Figure 5:
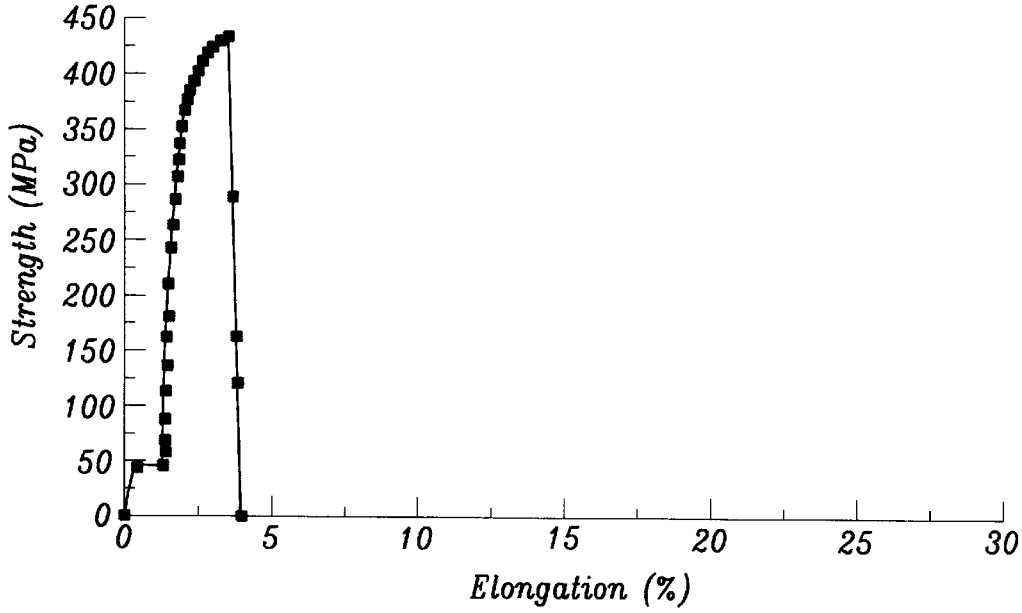
FIG. 5 is a graph illustrating strength versus elongation of the conventional shadow mask without annealing.
Figure 6:
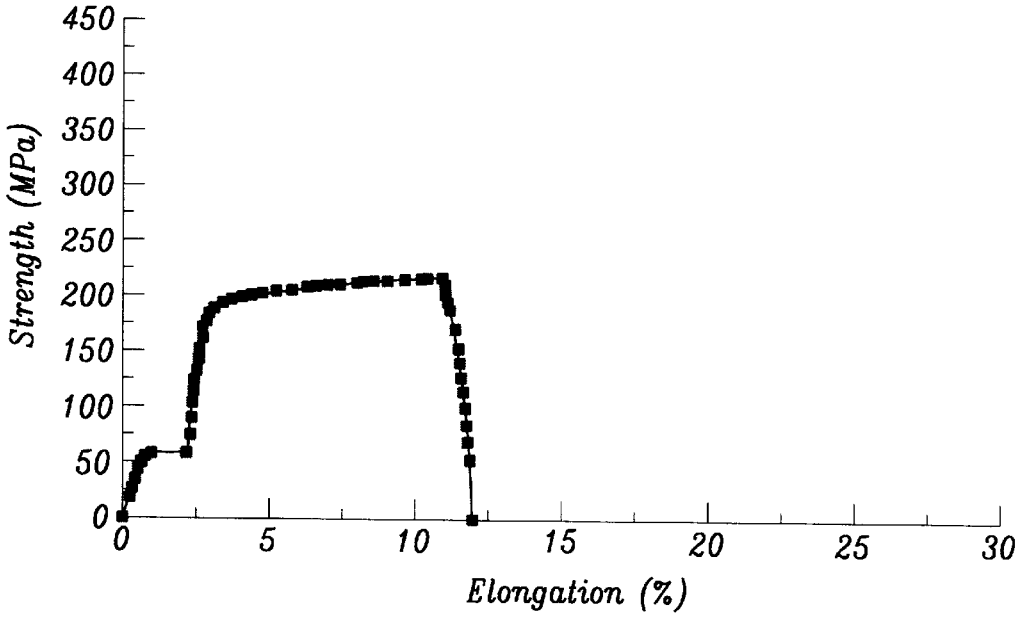
FIG. 6 is a graph illustrating strength versus elongation of the conventional shadow mask prepared by annealing.

The elongation and strength of conventional shadow masks without annealing and with annealing were determined, and the results are shown in FIGS. 5 and 6, respectively.

The method of the present invention can prepare the shadow mask with an improved tension strength by 40 to 60%, compared with the conventional shadow mask prepared by annealing.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A shadow mask for a cathode ray tube comprising:

a surface hardening layer comprising between about 0.01 and about 2.5 wt % nitrogen based on the weight of the shadow mask; and an interior hardening layer formed under the surface hardening layer, the interior hardening layer comprises between about 0.01 and about 2.0 wt % carbon based on the weight of the shadow mask.

2. The shadow mask of claim 1 wherein the shadow mask comprises a low thermal expansion material.

3. The shadow mask of in claim 1 wherein the shadow mask comprises aluminum-killed steel or invar steel.

4. A method of preparing a shadow mask comprising the steps of:

heat-treating an apertured metal plate with a carbonitriding gas capable of forming sufficient free nitrogen to form a surface hardening layer comprising at least 0.01 wt % nitrogen based on the weight of the shadow mask; and forming the heat-treated metal plate with a predetermined mask shape.

5. The method of claim 4 wherein the metal plate comprises a low thermal expansion material.

6. The method of claim 4 wherein the metal plate comprises aluminum-killed steel or invar steel.

7. The method of claim 4 wherein the carbonitriding gas comprises RX gas, propane and ammonia.

8. The method of claim 4 wherein the heat-treating step is carried out at a temperature between 400 and 1200° C.

9. The method of claim 4 wherein the heat-treating step is carried out for between 0.1 and 5 hours.

* * * * *